United States Patent [19]

Beny et al.

[11] 4,174,743

[45] Nov. 20, 1979

[54] SYSTEM FOR TRANSFERRING WATER

[76] Inventors: Janos Beny, 23775 Madison St., Torrance, Calif. 90505; Albert M. Herzig, 700 N. Rexford Dr., Beverly Hills, Calif. 90210

[21] Appl. No.: 853,498

[22] Filed: Nov. 21, 1977

[51] Int. Cl.[2] ..... B67D 5/54; B65B 3/04

[52] U.S. Cl. ..... 141/18; 137/212; 215/352; 215/364; 222/56; 222/400.8

[58] Field of Search ..... 141/18–29, 141/94, 95, 192–205, 279, 284, 285, 382, 383, 384, 385, 386, 392; 200/84 C; 222/56, 67, 136, 383, 400.8; 215/352, 364; 285/347, 344, DIG. 12; 137/209, 212

[56] References Cited

U.S. PATENT DOCUMENTS

| | | | |
|---|---|---|---|
| 2,805,798 | 9/1957 | Sampson | 222/400.8 |
| 4,030,634 | 6/1977 | Osborn | 222/400.8 |

FOREIGN PATENT DOCUMENTS

| | | | |
|---|---|---|---|
| 1559777 | 2/1969 | France | 222/400.8 |

*Primary Examiner*—Houston S. Bell, Jr.
*Attorney, Agent, or Firm*—Herzig & Walsh, Incorporated

[57] ABSTRACT

An integrated apparatus or device for transferring, that is, pumping water from a water bottle to a water fountain having a reservoir with a dispensing faucet. A housing is provided carrying a stopper for insertion into the neck of a water bottle. Within the housing, there is a pump; a tube is connected to the pump discharge and extends through the stopper for pumping air into the bottle. A further tube passes through the stopper for transferring water from the bottle. The other end of this tube extends to fitting means which can be placed on the reservoir in a position normally occupied by the water bottle in an inverted position. This fitting carries a float valve which closes the end of the supply tube when the reservoir is filled.

11 Claims, 7 Drawing Figures

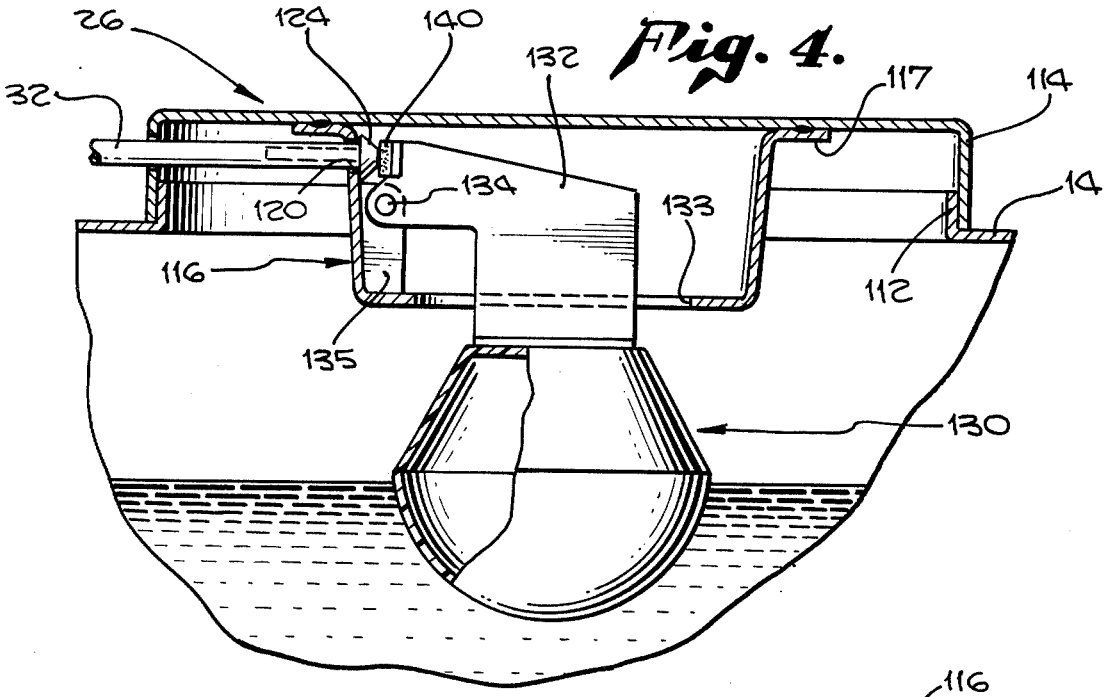
Fig. 4.
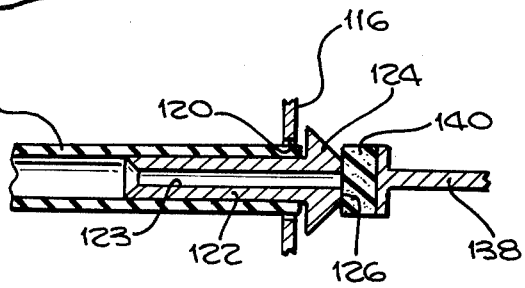
Fig. 5.
Fig. 6.
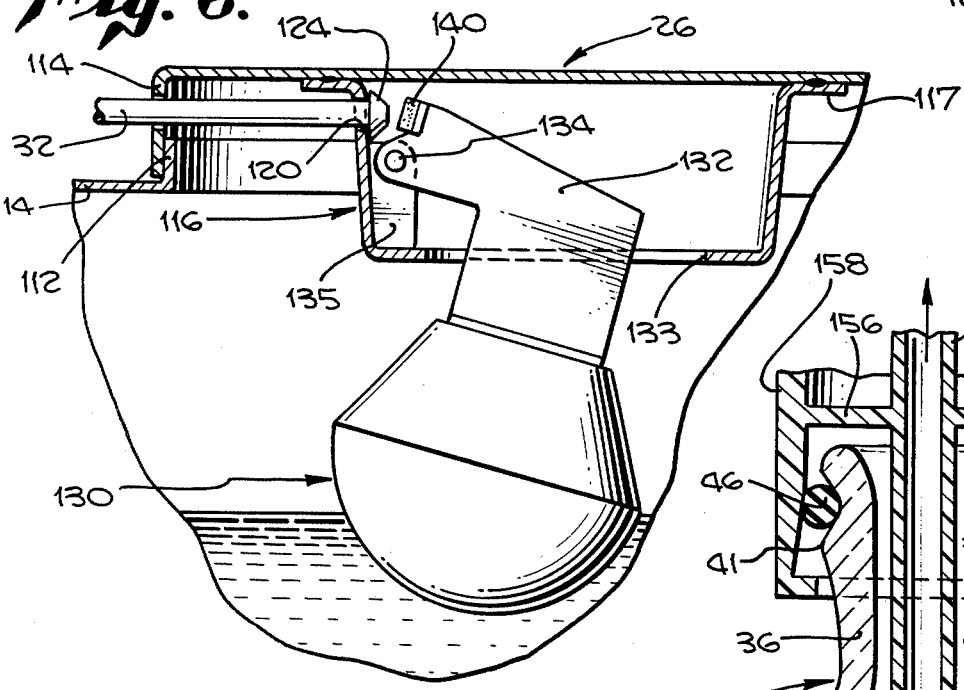
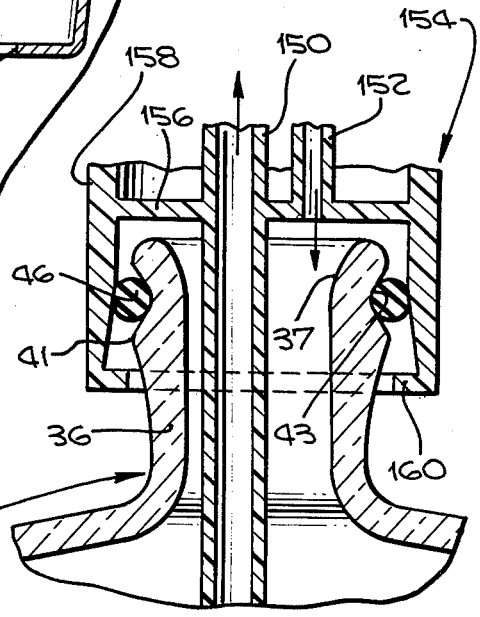
Fig. 7.

SYSTEM FOR TRANSFERRING WATER

BACKGROUND OF THE INVENTION

1. Field of the Invention

The field of the invention is that of water fountains, that is, drinking water facilities having a water reservoir and a dispensing faucet and, more particularly, to a unique integrated system for transferring water from a water bottle to the water reservoir.

2. Description of the Prior Art

Various systems for transferring water from one position to another are known in the art, including systems for pumping water or other liquid out of a bottle or other container and then transferring it to a higher level including dispensing the liquid. The prior art includes the following patents: U.S. Pat. Nos. 875,951; 1,070,681; 1,197,941; 1,308,091; 1,403,911; 1,587,609; 2,028,302; 2,038,915, 2,081,159; 3,173,534; and 3,825,154. The prior art does not disclose or teach the unique integrated self-contained system for transferring water from a water bottle to the water reservoir of a water fountain such as described in detail hereinafter.

SUMMARY OF THE INVENTION

The invention is briefly summarized in the abstract.

In the preferred exemplary form of the invention as described in detail hereinafter, it takes the form of an integrated self-contained apparatus or assembly adapted to be associated with a regular commercial water bottle and a water fountain for transferring water from the bottle to the reservoir of the fountain.

In the preferred exemplary form of the invention as described in detail herein, as stated, it is self-contained and so constructed that the device need only be inserted into the neck of the water bottle with tubes extending down into the bottle with another fitting carrying a float valve positionable over the reservoir in the position normally occupied by an inverted water bottle. There are no other installation requirements. The housing of the device carries the stopper that fits into the neck of the water bottle with the air and water tubes passing through the stopper. The pump carried in the housing is preferably electrically actuated. It pumps air down into the water bottle to pressurize it to force the water up through the tube and into the reservoir through the float valve. When the reservoir is filled, the float closes the float valve so that the pressure builds up in the bottle and in the pump discharge. Pressure actuated switch means are provided to then shut off the pump.

In the light of the foregoing, the primary object of the invention is to make available an integrated self-contained device or piece of apparatus having the capability of being associated with a commercial water bottle and a water fountain, for transferring water from the bottle to the reservoir of the fountain while the bottle merely rests on the floor adjacent to the fountain.

A further object is to realize apparatus as described that includes a fitting or closure member which can be placed over the top of the reservoir, this member or fitting including a float valve for controlling flow from the end of the water delivery tube.

A further object is to realize a self-contained system as described wherein the drive mechanism is positioned in a housing which carries a stopper which fits into the neck of the water bottle, the closure for the fountain reservoir and the float valve being at the discharge end of a water tube that passes through the stopper.

Further objects and additional advantages of the invention will become apparent from the following detailed description and annexed drawings.

BRIEF DESCRIPTION OF THE DRAWINGS

FIG. 4 is a sectional view taken along line 4—4 of FIG. 1;

FIG. 5 is a sectional view of the discharge end of the water tube and the valve means;

FIG. 6 is a view like FIG. 4 showing the float valve in another position.

FIG. 7 is a sectional view of an alternative form or cap or closure for the water bottle.

DESCRIPTION OF THE PREFERRED EMBODIMENT

Figure 1:
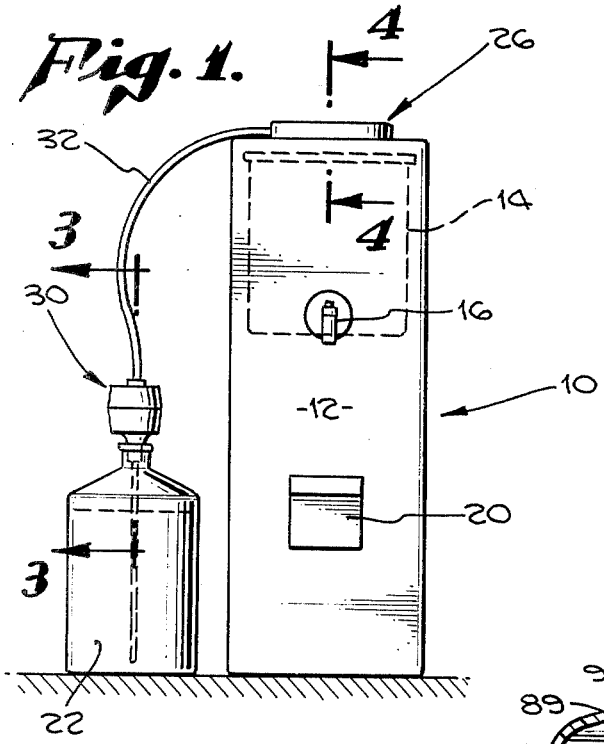
FIG. 1 is a view illustrating a preferred form of the invention.

Referring to FIG. 1 of the drawings, numeral 10 designates a typical commercial water fountain. It embodies an upright stand 12 in the upper part of which is a reservoir 14 for water having a manual discharge faucet 16. Typically, refrigeration means are provided within the apparatus for cooling the water in the reservoir 14. Numeral 20 designates a container on the outside of the fountain or cooler to catch drip from the faucet 16.

Numeral 22 designates a water bottle of typical commercial type in which fresh water can be purchased, the water being delivered in bottles like the bottle 22. At the top of the fountain or cooler 10 there is a circular opening above the reservoir 14 of a size such that the bottle 22 can be lifted up and inverted so that the upper end of the bottle rests on the edges of the opening. As shown in FIG. 1, there is provided a cover or fitting 26 which fits over the opening at the top of the reservoir as will be described more in detail presently.

The device of the herein invention includes a housing as designated at 30 and a tube 32 that extends to the fitting or cover 26 all as will now be described more in detail.

Figure 3:
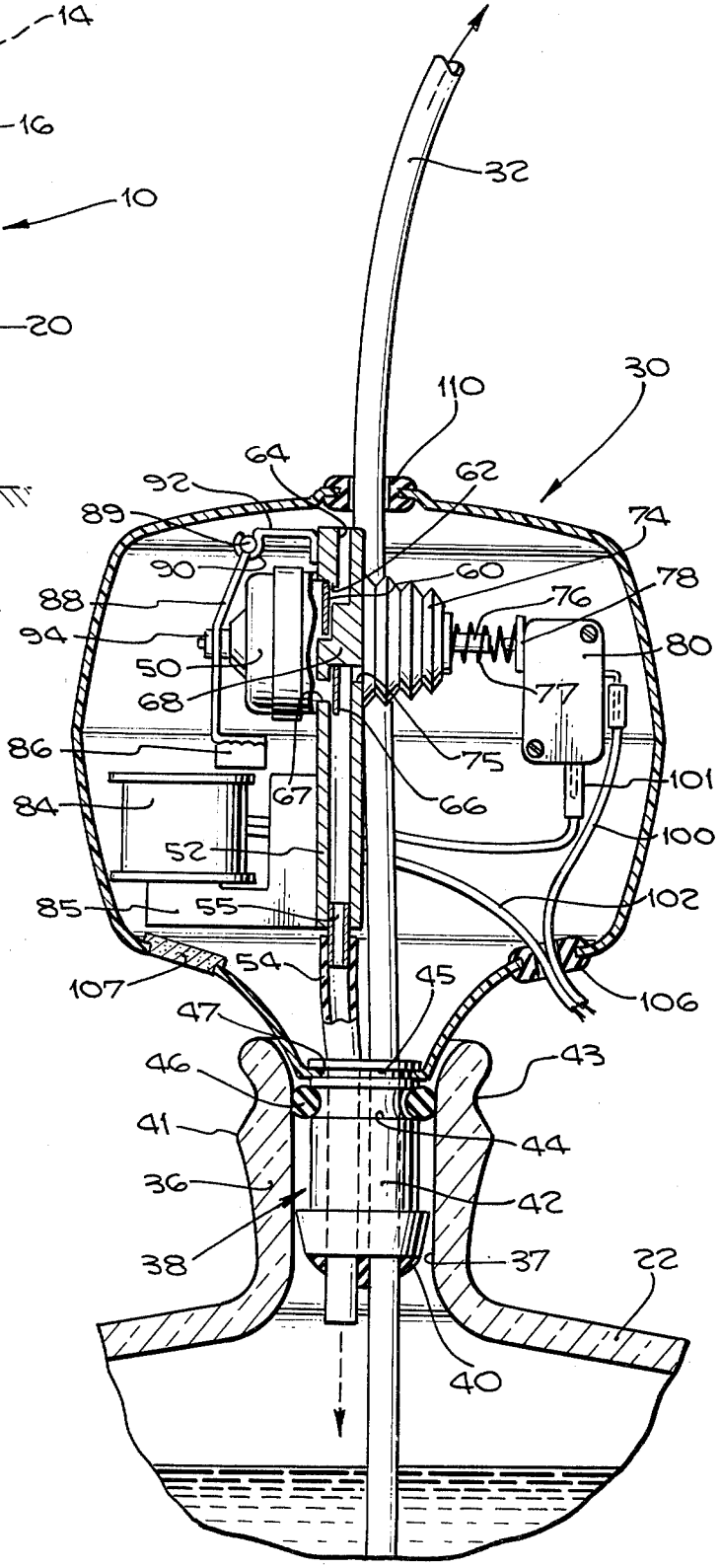
FIG. 3 is a cross-sectional view of a preferred form of the pump housing and stopper along with the air and water tubes that pass through the stopper.

FIG. 3 is a cross-sectional view showing the apparatus in greater detail. The housing 30 as shown is of generally globular shape. It may be constructed of any suitable material such as, for example, plastic. The bottle 22 has a neck 36 which has a bore 37. At the lower end of the housing 30 is a stopper member 38 adapted to fit into the bore 37 in the neck 36 of the bottle. The inlet to bore 37 has a gradual taper as shown. The outside of the neck has a contour as shown having annular rib 41 and groove 43. The lower part of the stopper member as designated at 40 is made of rubber to provide a closure for the bottle. The stopper 38 has an intermediate part 42 which is of smaller diameter and at the upper part of this portion is an annular groove. 44 which can receive an O-ring 36. Above the annular groove 44 is a smaller annular groove 46 and at the lower part of the of the housing 30 is an inwardly extending flange 47 that is received in the annular groove 46.

The O-ring is slightly larger than ordinarily would be needed. When the housing and stopper 38 are removed from the neck of the bottle, the O-ring 46 moves down onto the portion 42 of the stopper which is of smaller diameter than the part 40. When the stopper is pushed down into the bore 37 in the neck 36, the O-ring 46 will move up to fit into the groove 44 in the position shown in FIG. 3 to provide a seal at this position. The groove 44 prevents the O-ring from coming out of the neck. When the stopper is inserted, the outside of the O-ring engages the taper throat or neck of the bottle and it rolls between the parallel surfaces of the neck and the stopper. Thus it rolls down relative to the neck and up on the stopper into the groove 44.

From the foregoing it can be seen that the arrangement as described obviates the problem of excessive friction between the stopper and the neck of the bottle making it hard to withdraw and insert the stopper.

Within the housing 30 is mounted a diaphragm type pump 50 which can be of a known commercial construction. As shown, the pump is mounted on the side of a discharge 52. The lower end of this tube is coupled to a flexible tube 54 by way of coupling tube 55. The tube 54 extends down through the stopper 38 into the interior of the bottle 22. Associated with the pump 50 is an inlet and discharge valve assembly shown schematically in FIG. 3. The inlet valve includes a flexible diaphragm 60 which cooperates with a port 62 at the end of channel 64 through which air can be pumped from the interior of the housing 30. The outlet valve includes a flexible diaphragm 66 that cooperates with a port 67 leading to the tube 52. As schematically shown, the inner parts of the diaphragms 60 and 66 cooperate with an extending part 68.

Carried on the tube 52 is a bellows 74, there being a port 75 in the wall of the tube 52 whereby pressure in the tube 52 and in the bottle 22 is communicated to the bellows. The bellows has a stem 76 around which is a biasing spring 77 positioned between the bellows and a support member 78 carried by a microswitch housing 80.

The diaphragm pump 50 is operated electrically by an electrical actuator including an alternating current solenoid 84 carried on a bracket 85. Associated with the solenoid 84 is an armature 86 which is on the end of a lever 88 at the upper end of which is a ball 89 journalled in a bearing 90 at the end of bracket 92 extending from the tube 52. The intermediate part of the lever 88 is attached to the stem 94 of the diaphragm pump 50. When the solenoid 84 is energized by alternating current, the armature 84 is caused to vibrate, that is, to swing alternately back and forth and to thereby operate the diaphragm pump 50 to pump air from the interior of the housing 30 to the tube 22.

Switch 80 controls the diaphragm pump in response to the bellows 74 by way of electrical leads as designated at 100, 101 and 102 which extend through a rubber fitting 106 mounted in a wall of the housing 30. Numeral 107 designates a plug member in another opening in a side wall of the housing 30.

The water transfer tube 32 extends through a bore in the stopper 38 down into the lower part of the bottle 22 and through the upper part of the housing 30, extending through a rubber fitting 110 carried at an opening in the housing 30 as shown.

The cover or fitting 26 is shown more in detail in FIGS. 4 and 6. Around the opening at the top of the reservoir 14 is an upstanding or vertical flange 112. The cover or fitting 26 has a downwardly extending flange 114 of a fize to fit around the flange 112. Carried by the member 26 is an inverted cup-shaped member 116 having a flange 117 that is secured to the underside of the cover member 26. Tube 32 extends through an opening in the side of the cover 26 to an opening 120 in a side wall of the member 116 as may be seen in FIG. 5. In the end of the tube 32 there is a tubular fitting as designated at 122 having a bore 123 and having an enlarged tapered end portion 124 the flat end surface of which as designated at 126 forms a valve port.

Numeral 130 designates a float member carried by a bell crank lever 132 that is pivoted at 134 carried by a bracket 135 inside of the member 116. The bell crank lever 132 extends through opening 133 in member 116 and has an extending portion 138 at the end of which is carried a resilient member 140 that forms a valve member which cooperates with the valve port 126.

From the foregoing, the operation of the apparatus will be readily understood. The bellows 74 and microswitch 80 are set to operate in response to predetermined pressures within the bottle 22. At a predetermined low pressure, the microswitch will activate the diaphragm pump mechanism 50 which will pump air from within the interior of the housing 30 down into the tube 22. The pressure above the level of water in the bottle 22 will force water upwardly through the tube 32 into the reservoir 14 under control of the float mechanism 130 and valve 140. When the level rises sufficiently in the reservoir 14, the float mechanism will be actuated to close the valve formed by the port 126 and valve member 140. When this happens, the air pressure within the bottle 22 will build up, until at a predetermined pressure, the microswitch 80 will be activated to stop the diaphragm pump mechanism. The pump will remain inactivated until the pressure within the bottle 22 again falls to a predetermined value at which the pump will be restarted. This will occur after a substantial amount of water in the reservoir 14 has been used and then the reservoir 14 will be automatically refilled.

As may be understood from the foregoing, the system operates entirely automatically to transfer water from the bottle to the reservoir of the fountain or cooler. The need for lifting the bottle and inverting it and positioning it on top of the fountain or cooler is entirely eliminated. This positioning of a commercial water bottle requires considerable effort and there is danger of accident resulting from the possibility of the bottle slipping and falling or otherwise giving rise to a hazard. Such dangers and hazards are eliminated by the herein integrated apparatus. Installation of the apparatus for utilization is extremely simple since the stopper of the housing 30 need only be inserted into the neck of the bottle and the cover member 26 placed over the top of the reservoir. After doing this, the appliance is in condition for immediate operation. The appliance is unitary and may be marketed as a unitary article.

Figure 2:
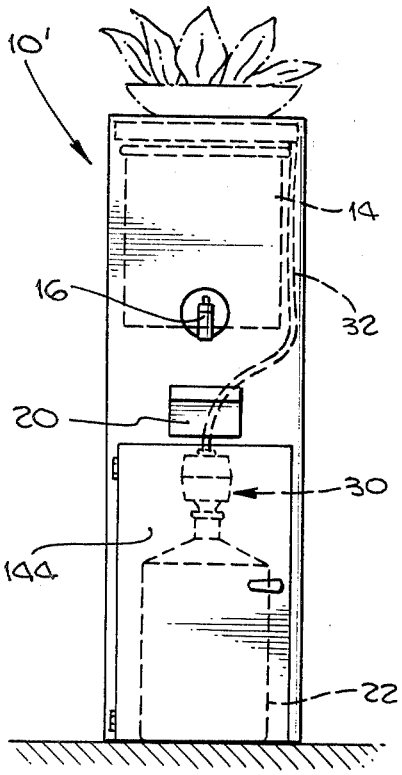
FIG. 2 illustrates another form of the invention wherein the water bottle is within a cabinet within the lower part of the water fountain.

FIG. 2 shows a slightly modified form of the invention wherein the water fountain or cooler has a cabinet in the lower part thereof, access to which may be had by way of a hinged door 144. In this form of the invention, the water bottle is placed within the cabinet at the lower part of the cooler.

FIG. 7 shows an alternative form of a cap or closure for the bottle associated with the pump or water transfer device. In the modification of FIG. 7 of housing 30 is like that of the previous embodiment having a water transfer tube or pipe 150 and an air pipe or tube 152.

Numeral 154 designates a cap or closure member for the water bottle 22, the cap or closure member 154 being cylindrical and positioned at the lower end of the housing 30 in the position of the stopper as described in connection with the previous embodiment. The cap 154 has a transverse wall 156 and water tube 150 and the air tube 152 extend through this wall. Cap 154 has a cylindrical skirt part 158, the end of which has an inwardly extending flange or lip 160. The skirt 158 is of a size to fit down over the neck 136 of the bottle with the O-ring 46 between the inside of the skirt 158 and the outer surface of the neck of the bottle.

When the housing and closure member are removed from the bottle, the flange 160 engages the O-ring 46 and pulls it past the upper end of the neck 36 of the bottle which is enlarged in diameter as shown. When the closure is replaced on the neck of the bottle, the O-ring 46 will roll downwardly on the outside surface of the neck of the bottle and will roll upwardly relatively, on the inside surface of the skirt 158 with the O-ring 46 coming into a position as shown in FIG. 7. Thus, it may be seen the objective is realized as in the previous embodiment, that the problem of excessive friction between the cap and the neck of the bottle is obviated when removing the closure and when putting it back on.

From the foregoing, those skilled in the art will fully appreciate and understand the nature and characteristics of the invention and the manner in which it achieves all of the objects as set forth in the foregoing.

The foregoing disclosure is representative of preferred forms of the invention and is to be interpreted in an illustrative rather than a limiting sense, the invention to be accorded the full scope of the claims appended hereto.

What is claimed is:

1. A water supply system adapted for utilization with a water dispensing system having a water reservoir and a dispensing faucet comprising in combination, a housing means which carries a stopper member adapted for insertion into the neck of a water bottle, pump means in the housing for pumping air and tubular means connected to the pump and extending through the said stopper so as to communicate with the interior of the water bottle, further tubular means extending through the stopper, further means to which the end of said further tubular means extends, said last means being constructed to be carried by the said water reservoir and including a float valve means for controlling flow from said further tubular means, said pump means being actuatable to pump air into the water bottle for forcing water from the water bottle into the water reservoir under control of the float valve means said further tubular means being a single tube extending from said housing to said further means.

2. Apparatus as in claim 1 including pressure responsive means for controlling the pump means, the pressure responsive means being responsive to pressure in the said water bottle whereby when the float valve means discontinues flow of water to the water reservoir, pressure builds up in the bottle and is operative to actuate the pressure responsive means.

3. Apparatus as in claim 1 including electrical means for driving the pump means.

4. Apparatus as in claim 1 wherein the said pump means is a reciprocating diaphragm type of pump.

5. Apparatus as in claim 3 wherein the said electrical means includes alternating current solenoid means having an armature mounted for swinging movement in accordance with the alternating current supply.

6. Closure means for a container having a neck, the end part of which has a rounded contour, the closure means including a closure member having an O-ring seal adapted for positioning between the closure member and the neck of the container, the closure member having means to retain the O-ring seal when the closure member is removed and the closure member having the capability of causing the O-ring seal to roll downwardly into sealing position with respect to the neck of the container, the sealing O-ring rolling upwardly relatively with respect to the closure member.

7. Closure means as in claim 6 wherein the closure member is in the form of a stopper engageable in the said neck of the container, the stopper having an annular groove to receive the O-ring seal in sealing position.

8. Closure means as in claim 6 wherein the closure member is in the form of a cap adapted for positioning over the neck of the bottle, the closure member including a skirt having a lip at the lower end thereof, egageable with the O-ring seal when the closure is removed.

9. A system as in claim 1 including a water bottle having a neck, the said stopper member having an O-ring seal adapted for positioning between the stopper member and the neck of the bottle, the stopper member having means to retain the O-ring seal when the stopper member is removed and the stopper member having the capability of causing the O-ring seal to roll downwardly into sealing position with respect to the neck of the bottle, the sealing O-ring rolling upwardly relatively with respect to the stopper member.

10. A system as in claim 9 wherein the stopper member is engageable in the neck of the bottle, the stopper member having an annular groove to receive the O-ring seal in sealing position.

11. A system as in claim 9 wherein the stopper member is in the form of a cap adapted for positioning over the neck of the bottle, the stopper member including a skirt having a lip at the lower end thereof engageable with the O-ring seal, when the stopper member is removed.

* * * * *